US010924843B2

(12) United States Patent
Heaston et al.

(10) Patent No.: US 10,924,843 B2
(45) **Date of Patent: *Feb. 16, 2021**

(54) HEADBAND ASSEMBLY

(71) Applicant: Bose Corporation, Framingham, MA (US)

(72) Inventors: Jeremy Heaston, Ashland, MA (US); Alison Leedham, Allston, MA (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/897,065

(22) Filed: Jun. 9, 2020

(65) Prior Publication Data

US 2020/0304894 A1 Sep. 24, 2020

Related U.S. Application Data

(63) Continuation of application No. 16/058,363, filed on Aug. 8, 2018.

(51) Int. Cl.
*H04R 1/00* (2006.01)
*H04R 1/10* (2006.01)

(52) U.S. Cl.
CPC ..... *H04R 1/105* (2013.01); *H04R 1/1008* (2013.01); *H04R 1/1058* (2013.01)

(58) Field of Classification Search
CPC .... H04R 5/033; H04R 5/0335; H04R 1/1008; H04R 1/105; H04R 1/1058
See application file for complete search history.

(56) References Cited

U.S. PATENT DOCUMENTS 6,449,806 B1 * 9/2002 Engelhard ..... H04M 1/05 2/209
2014/0205130 A1 * 7/2014 Blair ..... H04R 5/0335 381/378
2015/0272292 A1 * 10/2015 Taylor ..... H04R 5/0335 132/275

* cited by examiner

*Primary Examiner* — Matthew A Eason
(74) *Attorney, Agent, or Firm* — Brian M. Dingman; Dingman IP Law, PC

(57) ABSTRACT

A headband assembly that is constructed and arranged to be worn on or over a head of a user, having a curved compliant spring member, a cushion member that is configured to be in contact with or proximate the head of the user when the headband assembly is worn by the user, a spine that is coupled to both the cushion member and the spring member, and a cap that at least partially overlies the spring member and the spine.

22 Claims, 14 Drawing Sheets

HEADBAND ASSEMBLY

CROSS-REFERENCE TO RELATED APPLICATION

This application is a continuation of and claims priority of application Ser. No. 16/058,363 filed on Aug. 8, 2018.

BACKGROUND

This disclosure relates to a headband assembly that can be used with headphones.

Some headphones have earcups carried at the opposed ends of a headband. The headband provides a clamping force that helps to maintain the headphones on the head.

SUMMARY

All examples and features mentioned below can be combined in any technically possible way.

In one aspect, a headband assembly that is constructed and arranged to be worn on or over a head of a user includes a curved compliant spring member, a cushion member that is configured to be in contact with or proximate the head of the user when the headband assembly is worn by the user, a spine that is coupled to both the cushion member and the spring member, and a cap that at least partially overlies the spring member and the spine.

Embodiments may include one of the above and/or below features, or any combination thereof. The cushion member may comprise a pocket, and the spine may be received in the pocket. The spine may comprise a plurality of spaced projections on an upper surface of the spine, and the pocket may comprise a plurality of spaced openings that are configured to receive the spine projections, to interface and align the spine and the cushion member. The spring member may comprise a slot along a length thereof, wherein the slot has edges. The spine may comprise a plurality of spaced coupling tabs on an upper surface thereof. The coupling tabs may be configured to couple to the spring member slot edges. The coupling tabs may each comprise a shoulder that is arranged to snap fit with the spring member and sit against and over a spring member slot edge. The coupling tabs may comprise cantilever snap fit members that have curved free distal ends.

Embodiments may include one of the above and/or below features, or any combination thereof. The spine may be elongated, and may engage along a length of the spring member. The spine may comprise an elongated spring to provide a head clamping force to the spine. The cushion member may be elongated, and may have a central portion that is in the middle of the cushion member. The spine may comprise an upper spine member that engages with the central portion of the cushion member. The upper spine member may have opposed ends. The spine may further comprise two lower spine members, one proximate each end of the upper spine member. Each lower spine member may engage with both the cushion member and the spring member. The spring member may have a lower surface. The lower spine members may be adhesively engaged with the lower surface of the spring member.

Embodiments may include one of the above and/or below features, or any combination thereof. The cap may comprise a cap spine portion and a cap cover portion. The cap spine portion and the cap cover portion may be co-molded. The spring member may comprise a slot along a length thereof, wherein the slot has edges. The cap may be elongated, and may engage with the spring member slot. The cap spine portion may comprise a plurality of spaced coupling tabs. The cap spine portion coupling tabs may be configured to couple to the spring member slot edges. The cap spine portion coupling tabs may each comprise a shoulder that is arranged to snap fit with the spring member and sit against and under a spring member slot edge. The cap cover portion may have outer edges that engage with the spring member. The outer edges of the cap cover portion may have elongated grooves that increase the compliance of the outer edges of the cover portion.

Embodiments may include one of the above and/or below features, or any combination thereof. The cap may comprise opposed ends. The cap spine portion at each cap end may comprise a lower tongue that is located underneath the head assembly spine. The cap spine portion may be pre-molded in a straight configuration. The cap cover portion may comprise two edges and a groove along each of the two edges. The cap spine portion may be pre-molded in a curved configuration.

In another aspect, a headband assembly that is constructed and arranged to be worn on or over a head of a user includes a curved compliant spring member that comprises a slot along a length thereof. The slot has edges. A cushion member is configured to be in contact with or proximate the head of the user when the headband assembly is worn by the user. The cushion member comprises a pocket. An elongated spine is received in the cushion member pocket, is coupled to the cushion member, and engages along a length of the spring member. The spine comprises a plurality of spaced projections on an upper surface of the spine and the pocket comprises a plurality of spaced openings that are configured to receive the spine projections so as to interface and align the spine and the cushion member. The spine further comprises a plurality of spaced coupling tabs on an upper surface thereof. The coupling tabs each comprise a shoulder that is arranged to snap fit with the spring member and sit against and over a spring member slot edge. An elongated cap at least partially overlies the spring member and the spine. The cap comprises a cap spine portion and a cap cover portion. The cap engages with the spring member slot. The cap spine portion comprises a plurality of spaced coupling tabs that each comprise a shoulder that is arranged to snap fit with the spring member and sit against and under a spring member slot edge.

DETAILED DESCRIPTION

Figure 1A:
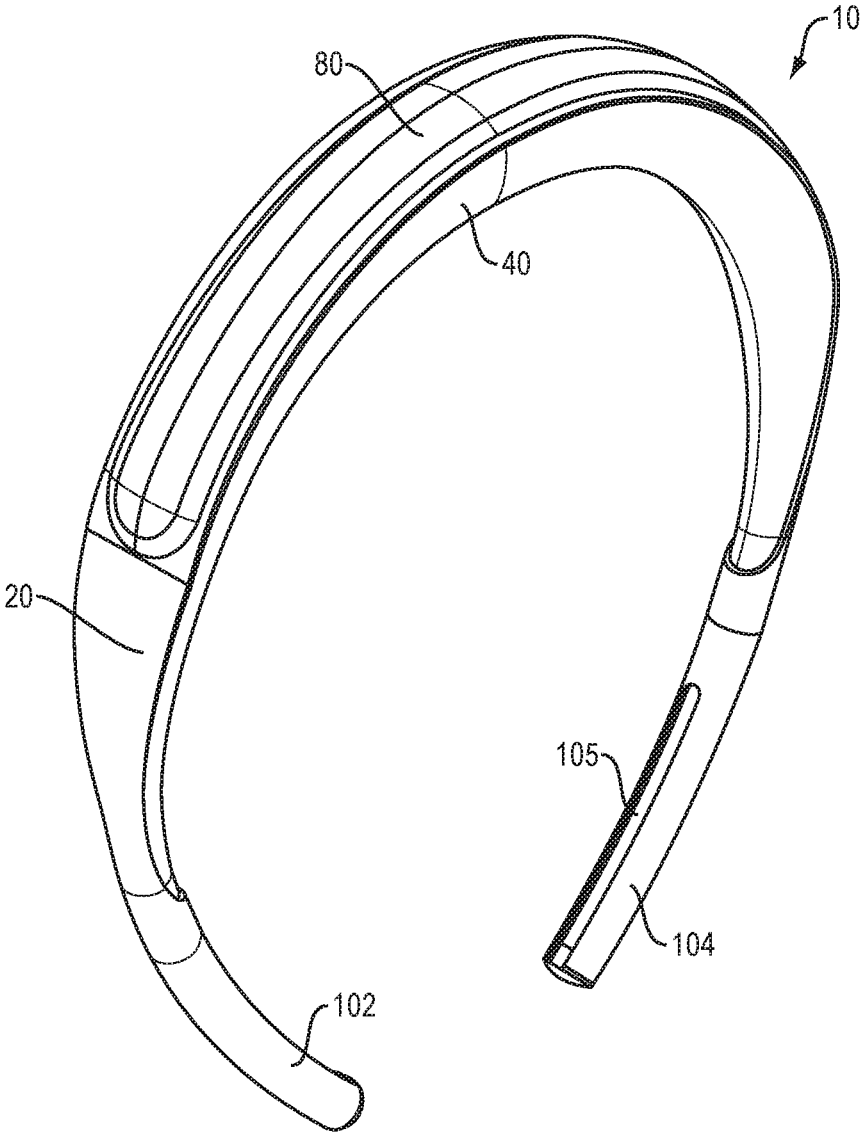
FIG. 1A is a perspective view of a headband assembly.

This disclosure is based, at least in part, on the realization that a visually appealing headband assembly that also exhibits a head clamping force that is sufficient to maintain the headband in place on most heads and seal the headphone system to a wearer's head, while also being comfortable to wear, can be beneficially incorporated into a continuous headband spring headphone system. The headband assembly has a curved compliant spring member, a cushion member that is configured to be in contact with or proximate the head of the user when the headband assembly is worn by the user, a spine that is coupled to both the cushion member and the spring member, and a cap that at least partially overlies the spring member and the spine.

A headphone refers to a device that fits around, on, or in an ear and that radiates acoustic energy into the ear canal. Headphones are sometimes referred to as earphones, earpieces, headsets, earbuds or sport headphones, and can be wired or wireless. A headphone includes an acoustic driver to transduce audio signals to acoustic energy. The acoustic driver may be housed in an earcup. While some of the figures and descriptions following may show a single headphone, a headphone may be a single stand-alone unit or one of a pair of headphones (each including a respective acoustic driver and earcup), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality such as a microphone so that they can function as a headset.

In an around or on-the-ear headphone, the headphone may include a headband and at least one earcup that is arranged to sit on or over an ear of the user. To accommodate heads of different sizes and shapes, the earcups may be configured to pivot about the vertical and/or horizontal axes, and to translate for some distance along the vertical axis.

Headphones according to various implementations herein can include a headband assembly comprising a continuous headband spring coupled with one or more earcups. The headband assembly can provide the desired clamping pressure in the headphones to maintain contact between the earcup(s) and the user's head. The continuous headband spring can be formed of a single piece of material (e.g., a metal or composite material) or can be formed of a plurality of separate pieces coupled together. The continuous headband spring can be coupled with a head cushion for interfacing with a user's head. In particular cases, the continuous headband spring connects a pair of earcups. This continuous headband spring configuration can allow for adjustment of the position of the earcups without modifying a position of the headband spring or the cushion. That is, the continuous headband spring configuration allows the user to adjust the position of the earcups relative to the headband spring, without altering the length of the headband spring (or the cushion).

Figure 1B:
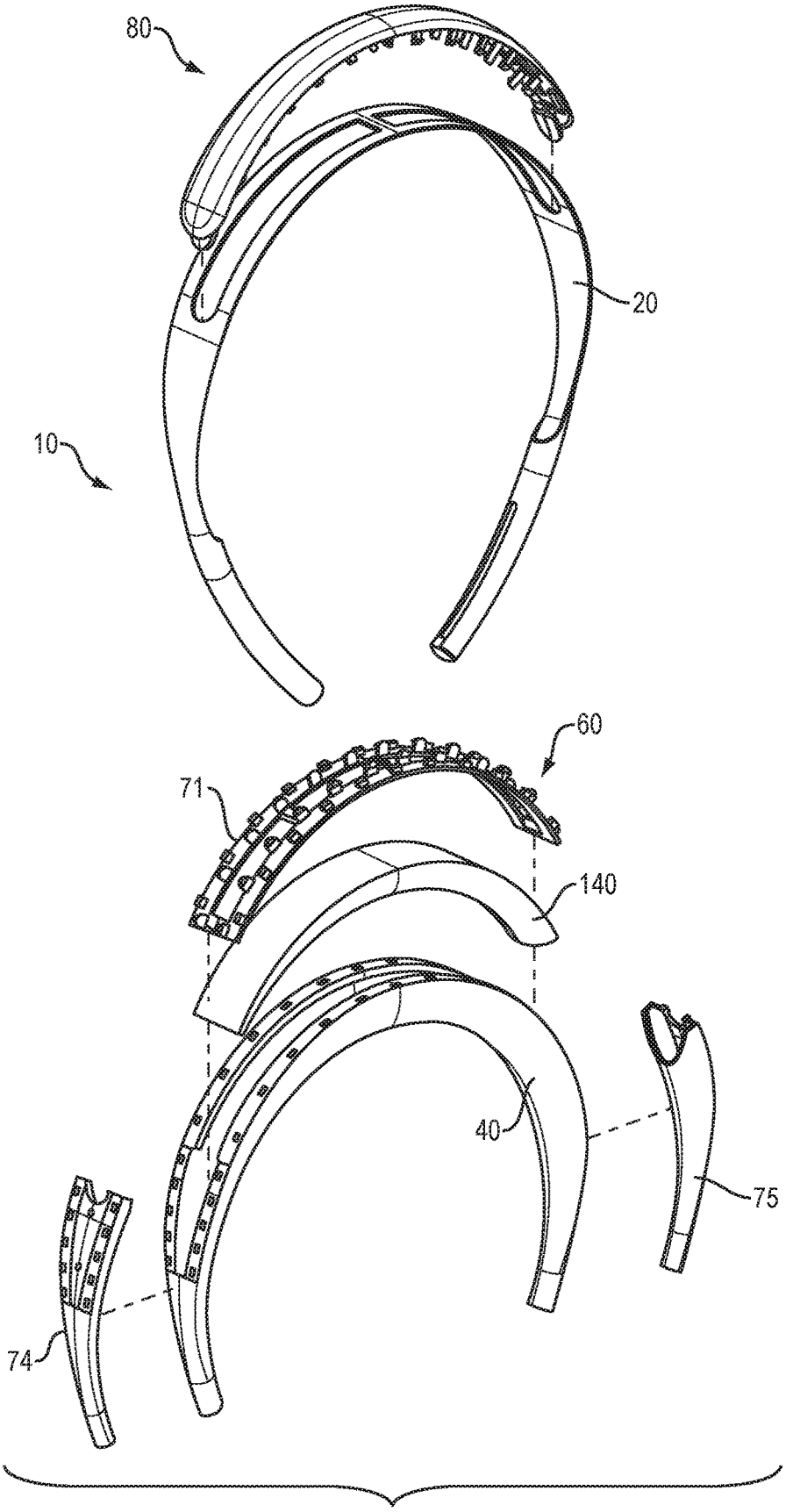
FIG. 1B is an exploded view thereof.

Headband assembly 10 is illustrated assembled in FIG. 1A and exploded in FIG. 1B. FIG. 1A also depicts sliders 102 and 104 that are rotatably coupled to the ends of headband assembly 10. Typically, the earcups (not shown) would be carried by sliders 102 and 104 such that the earcups can be moved up and down (e.g., along slot 105) and can rotate side-to-side (about both a vertical and horizontal axis). These motions are provided for so that the earcups can comfortably fit on or over the ears of most people. Since the sliders and earcups do not form parts of the headband assembly, they are not further described herein.

Headband assembly 10 is constructed and arranged to be worn on or over a head of a user and includes curved compliant spring member 20 (also referred to herein as continuous headband spring), cushion member 40 that is configured to be in contact with or proximate the head of the user when headband assembly 10 is worn by the user, spine 60 that is coupled to both cushion member 40 and spring member 20, and cap 80 that at least partially overlies the spring member and the spine. Optional foam piece 140, FIG. 1B, can be located between the underside of spine 60 and the bottom of cushion member 40. Foam piece 140 may be attached to the underside of the spine. The foam can help guide the electrical cable that runs through the headband (the cable may be used, for example, to transfer signals and/or power between the earcups). The foam also gives cushion member 40 more structure, and is the primary structure that gets compressed against the user's head when the headphone is worn on the head. Spine 60 in this non-limiting example comprises upper spine member 71 and identical lower spine members 74 and 75, but in other examples, the upper and lower spine members could be integrally formed as a single unitary spine member. When assembly 10 is fully assembled, the cushion member, the spring member and the cap are the only portions that are visible. The external portions of the cushion member and the cap can be made from a compliant material that provides comfort to the wearer and also presents a uniform appearance. In one non-limiting example, this material can be a biocompatible silicone, with or without a silicone-based coating to make the material dust-proof. The spring member is made from a stiff but compliant material such as spring steel that provides clamping force to the headband assembly and also presents a uniform appearance. Assembly 10 is thus both functional and aesthetically pleasing.

Figure 2A:
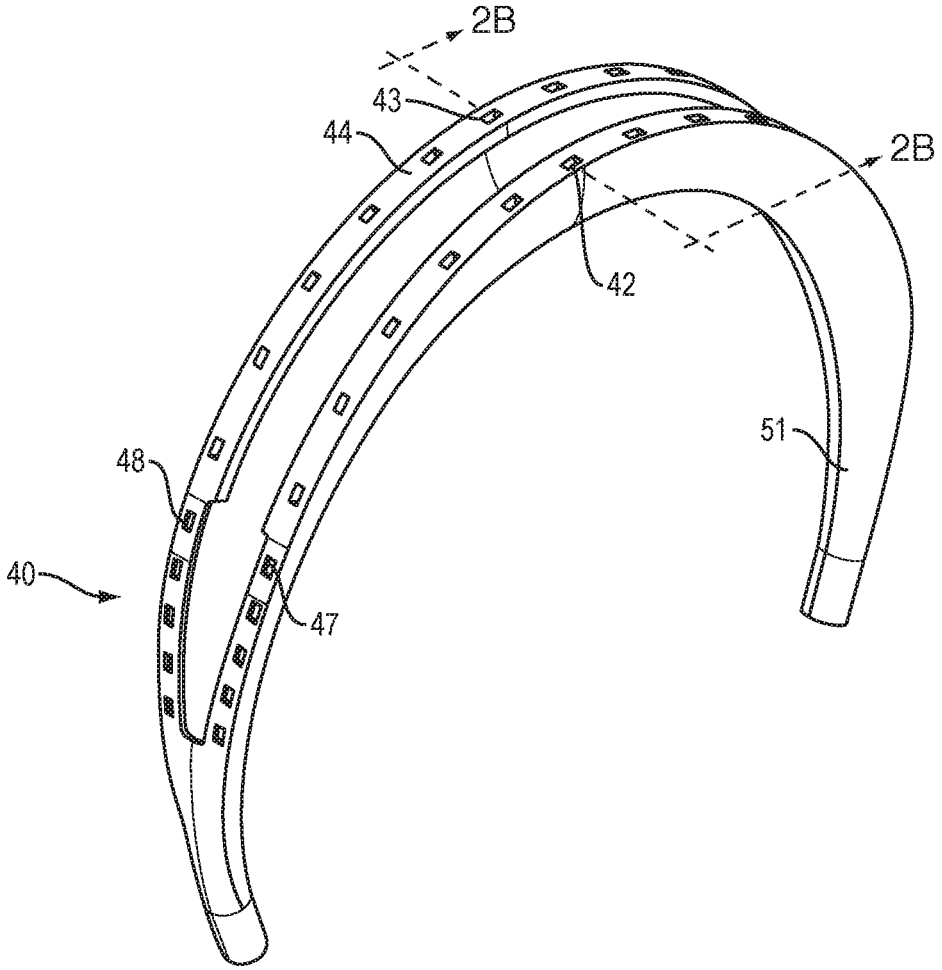
FIG. 2A is a perspective view of a cushion member of a headband assembly.
Figure 2B:
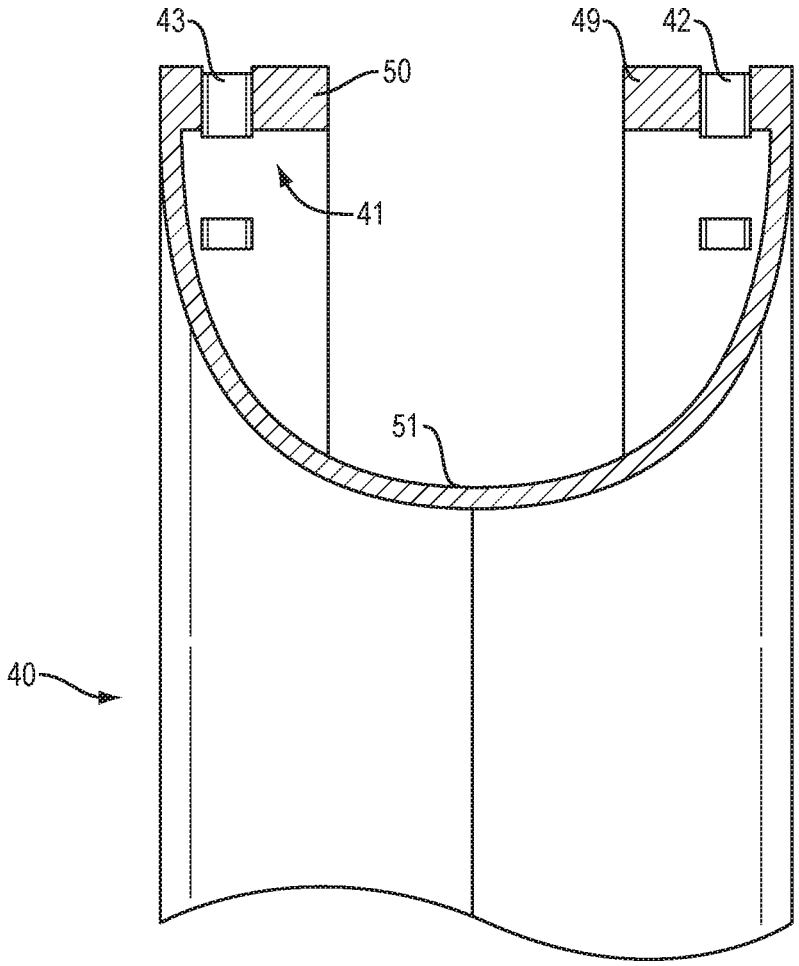
FIG. 2B is a cross-section taken along line 2B-2B, FIG. 2A.
Figure 3A:
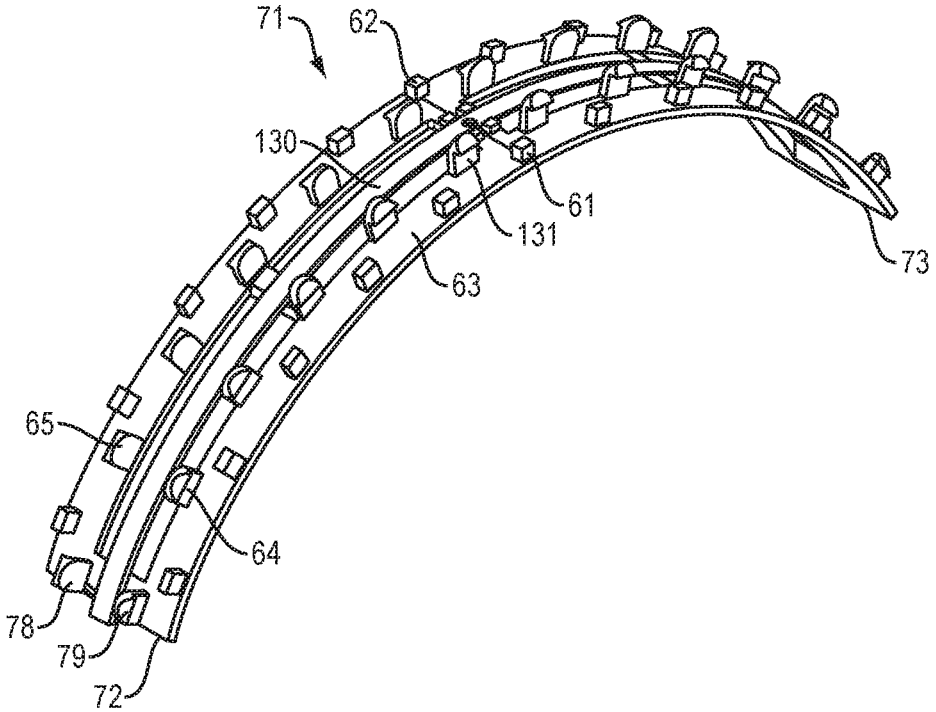
FIG. 3A is a perspective of an upper spine of a headband assembly.
Figure 3B:
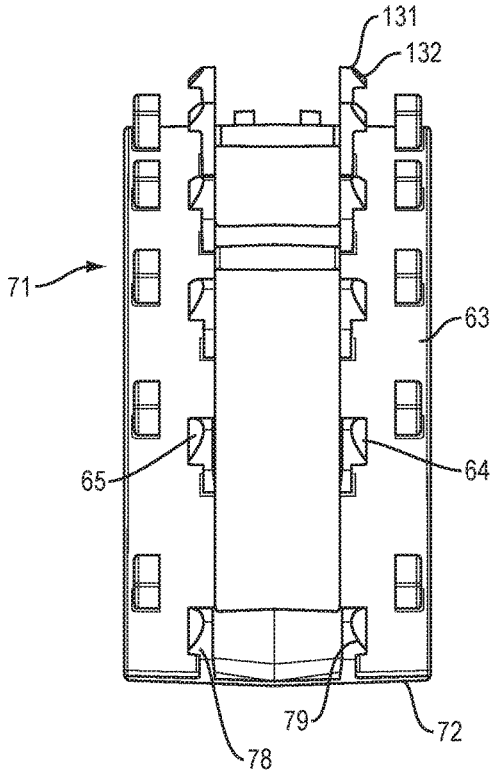
FIG. 3B is an end view of the upper spine of FIG. 3A.
Figure 3C:
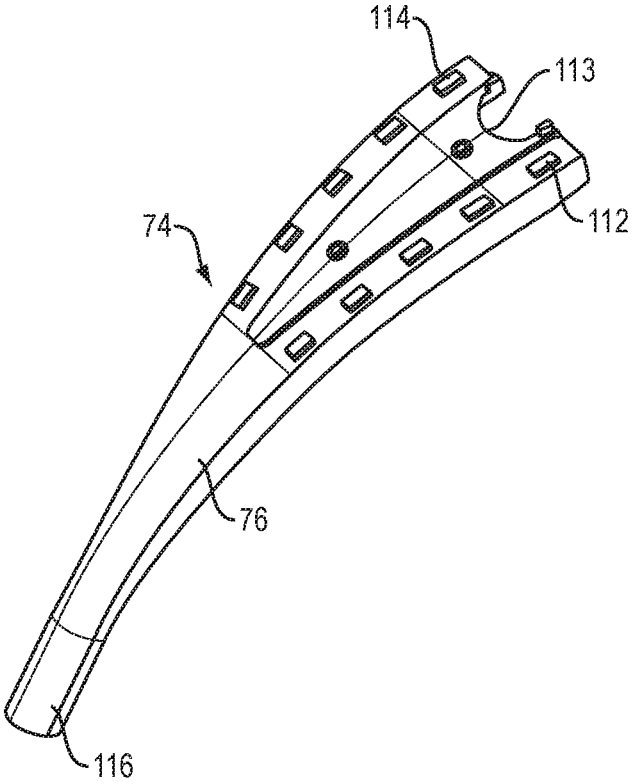
FIG. 3C is a perspective view of a lower spine of a headband assembly.

Cushion member 40, FIGS. 2A and 2B, is preferably constructed and arranged to interface with spine 60 such that spine 60 can couple to spring member 20, as further explained below. In one non-limiting example the interface is arranged such that the spine sits within the cushion member, with portions of the spine that couple to the spring member projecting upward, above the top of the cushion member. In the present example, cushion member 40 has upper projecting overhangs 49 and 50 that are spaced above base 51 which will sit on or proximate the head. The open volume 41 between the base and the overhangs defines a pocket. Some or all of spine 60 is received in the pocket. As shown in FIGS. 3A-3C, spine 60 may comprises upper spine member 71 and separate lower spine members 74 and 75. Alternatively, the spine may be a single unitary member.

Figure 4:
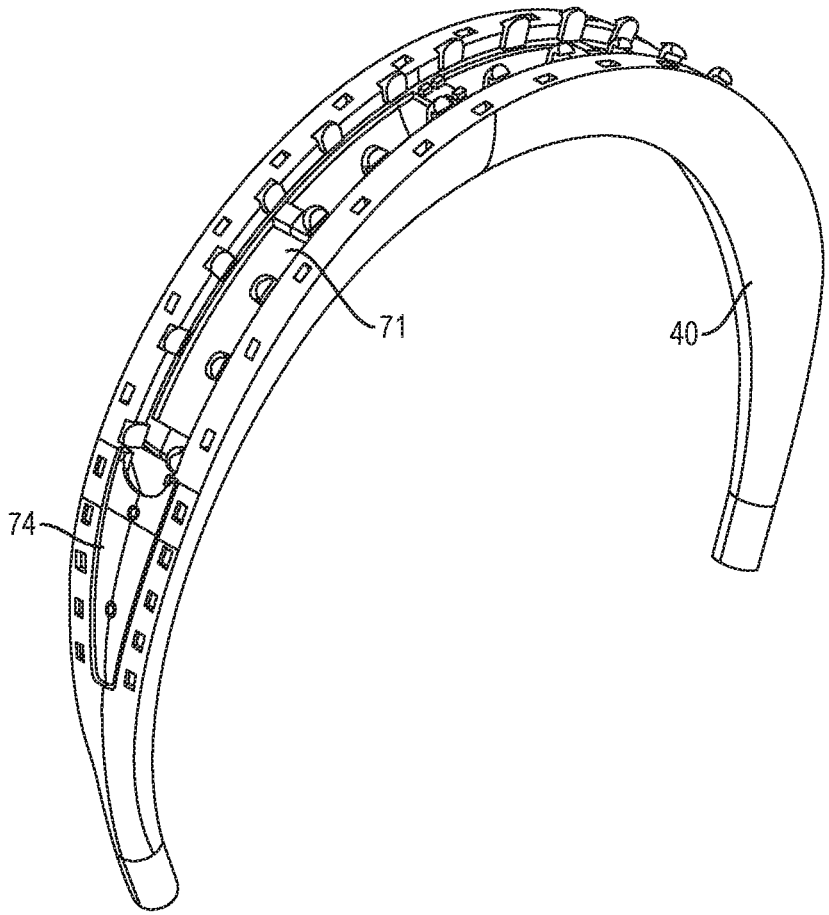
FIG. 4 is a perspective view of a spine engaged with a cushion of a headband assembly.

Spine 60 in this non-limiting example comprises a plurality of spaced projections on an upper surface of the spine. For example, as shown in FIG. 3A, upper surface 63 of upper spine member 71 has two rows of spaced projections on the outside edges, with only the two central projections 61 and 62 numbered simply for the sake of convenience of explanation. Similarly, lower spine members 74 and 75 may have two rows of spaced projections, with only the two upper projections 112 and 114 of lower spine member 74 numbered simply for the sake of convenience of explanation. See FIG. 3C. The projections of the upper and lower spine members are configured to fit into spaced receiving openings in the cushion member. For example, as shown in FIGS. 2A and 2B, cushion member 40 comprises two rows of spaced openings that each receive a projection of the spine. Openings 42 and 43 in central portion 44 of cushion member 40 receive spine projections 61 and 62, respectively, while openings 47 and 48 receive projections 112 and 114, respectively. FIG. 4 illustrates spine 60 (comprising upper spine member 71 and lower spine members 74 and 75) interfaced with cushion member 40. As can be seen, the series of projections and projection-receiving openings serve to interface or interfit and properly align the spine and the cushion member such that the spine-spring coupling tabs (further explained below) project above the cushion member and are placed in the correct position to hold the spring member against the top of the cushion member in the correct orientation such that the cushion member hides the lower part of the spring member. The cap 80 then hides the spine-spring interface, so that in the assembled headband assembly none of the structure that couples the cushion member to the spring is visible.

Figure 5:
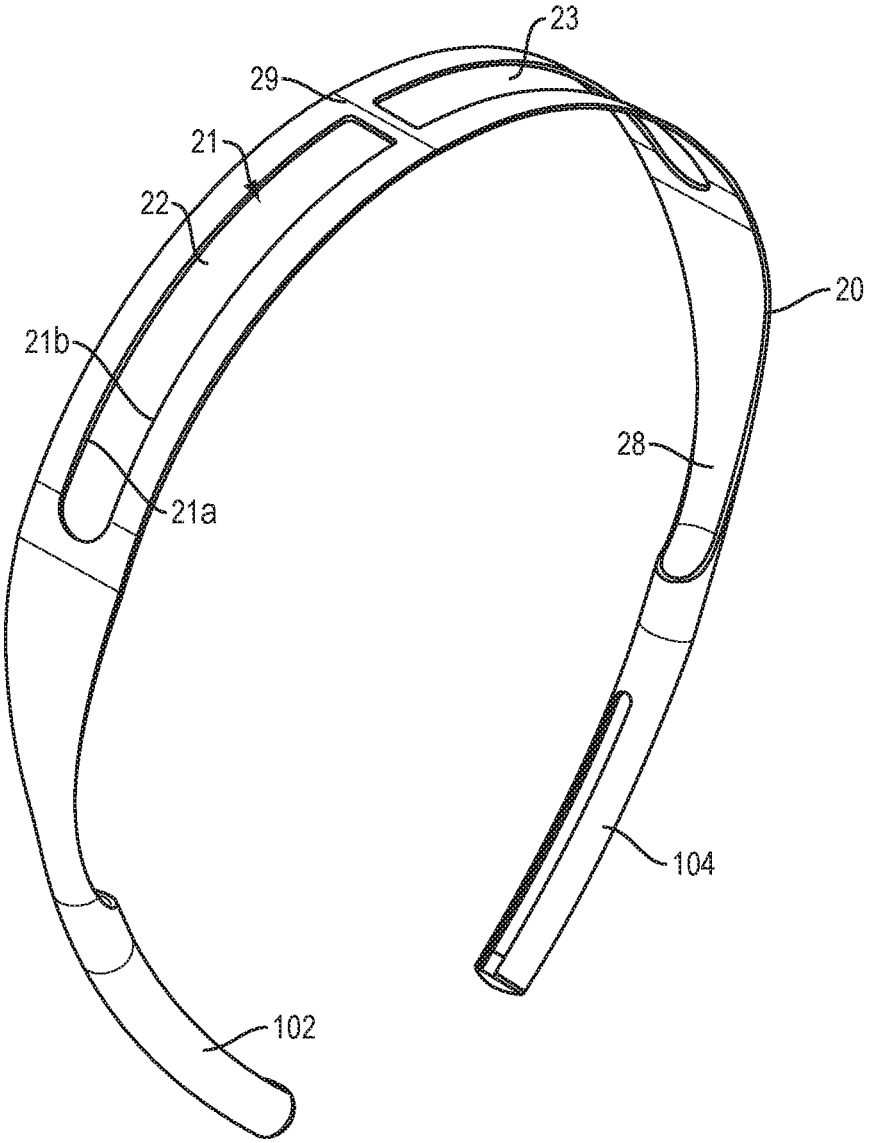
FIG. 5 is a perspective view of a spring member of a headband assembly.
Figure 6:
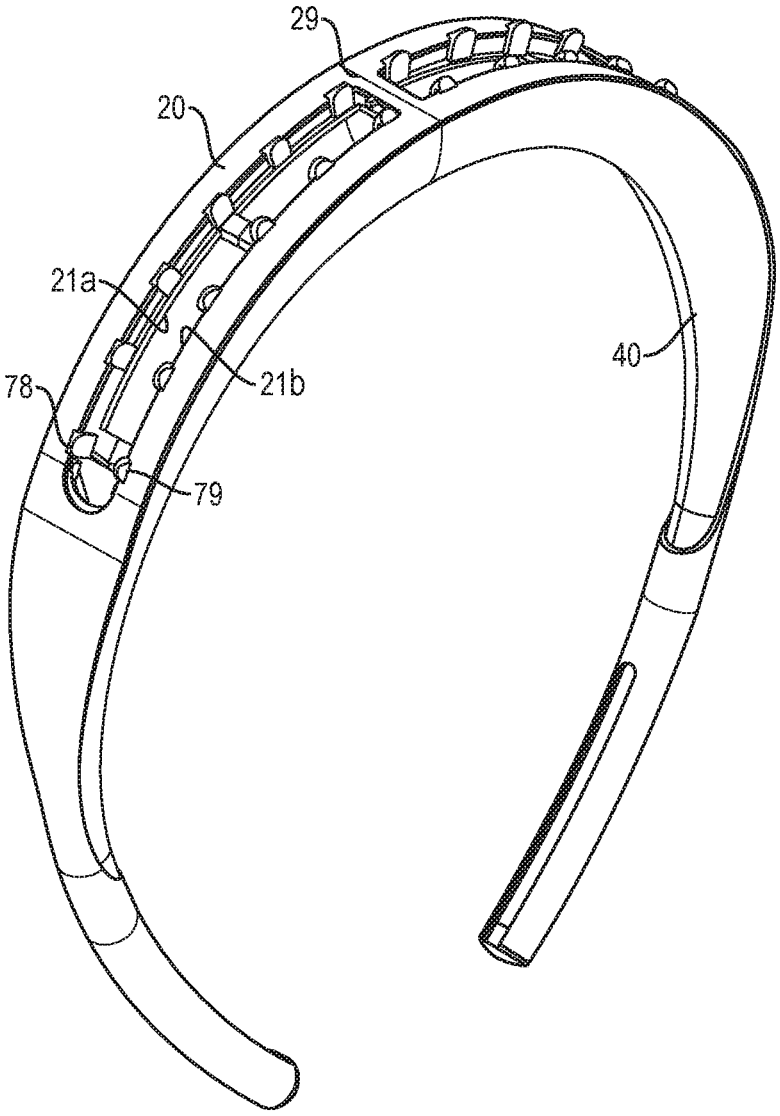
FIG. 6 is a perspective view of the spine and cushion of FIG. 4 engaged with the spring member of FIG. 5.

Upper spine member 71 (FIG. 3A) also has a plurality of upwardly-projecting spaced coupling tabs on an upper surface 63 thereof. The coupling tabs may be configured to couple to the spring member. In one non-limiting example shown in FIGS. 3A-3C, upper spine member 71 has two spaced rows of coupling tabs, with only end tabs 78 and 79, adjacent tabs 64 and 65, and more central tab 131 numbered, simply for the sake of convenience of explanation. Each coupling tab may be constructed and arranged to snap-fit with the spring member 20. The coupling tabs may each comprise a shoulder (see, e.g., shoulder 132 of coupling tab 131, FIG. 3B). The shoulders may be arranged to snap fit with the spring member 20. In one non-limiting example, this interfitting and interlocking of the spine and the spring member may be accomplished as follows. Spring member 20, FIG. 5, includes slot 21 along at least part of the length of the spring member. Slot 21 in this non-limiting example includes two spaced slot portions 22 and 23 separated by spring stiffening ridge 29. Slot 21 has edges 21*a* and 21*b*. The spine coupling tabs may be configured to couple to these spring member slot edges. For example, the shoulders of the coupling tabs may be arranged to snap fit with the spring member and sit against and over a spring member slot edge. See FIG. 6, which illustrates the coupling tabs coupled to the spring member. For example, the shoulders of coupling tabs 78 and 79 sit against and over edges 21*a* and 21*b* of spring slot 21 and on the top 31 of spring member 20. The coupling tabs may comprise cantilever snap fit members that have curved free distal ends to better interface with the cap, as further explained below.

The spine may be elongated as shown, and may engage along a length of the spring member, as shown. The spine may comprise an elongated spring to provide a head clamping force to the spine. For example, upper spine member may include spring steel member 130, FIG. 3A, that is fixed to the spine in any mechanical manner. For example, a small screw (not shown) may be used to fix member 130 to member 71 either at the middle of the spring steel member 130 or at each of the ends of the spring steel member 130. In one non-limiting example, the elongated spring is approximately the same length as the upper spine member 71. The elongated spring may be used to tune the clamping force generated by the spine. For example, by varying the geometry of the elongated spring (e.g., its thickness, width, etc.), the amount of clamping force contributed by the spine to the overall headband assembly may be varied.

The spine may comprise an upper spine member that engages with the central portion of the cushion member. The upper spine member may have opposed ends 72 and 73. The spine may further comprise two lower spine members 74 and 75, one proximate each end 72 and 73 of the upper spine member. Each lower spine member may engage with both the cushion member and the spring member. The spring member may have a lower surface 28. The lower spine members may have lower ends (e.g., end 116, FIG. 3C) that sit inside of the lower ends of the cushion member. The lower spine members may be adhesively engaged with the lower surface of the spring member, e.g., by using a pressure-sensitive adhesive on the outer surface of the lower spine members (e.g., on surface 76 of lower spine member 74, FIG. 3C) and constructing the lower spines and the spring such that the lower surfaces of the spring that overlie the lower spine members will sit directly on and thus adhesively engage with the lower spine members. In one non-limiting example, the upper and lower spine members may be constructed of polypropylene.

This disclosure contemplates further options, alternatives, and advantages to the headband assembly. For example, the spine 60 provides a means for achieving better alignment between the compliant cushion member 40 and the headband spring member 20. The upper spine member 71 and the lower spine members 74, 75 (which may be rigid and/or fully enclosed in the headband assembly) together allow the cushion member 40 to be substantially uniformly compressed to the spring member 20 at nearly all spring opening sizes (to fit on different head widths), while at the same time controlling the gap between the cushion member 40 and spring member 20 to be zero or near-zero. However, discontinuities in the spine 60 may result in gaps between the cushion member 40 and the spring member 20. Such gaps can potentially be reduced or eliminated by constructing the spine 60 as a single piece, thereby eliminating discontinuities and any gaps between the cushion member 40 and the spring member 20. Spine 60 could be integrally formed as a single part, e.g., by molding of a plastic material. Alternatively, a single piece construction could be accomplished using two parts, a first lower part that was configured to mate to the spring member 20, and a second upper part that was configured to overlay and directly connect to the first part, like a cap. The second part could be snapped, glued, welded, or otherwise fixed to the lower part.

The upstanding projections such as projections 112 and 114 on the lower spine members 74, 75 may be made larger than depicted in FIG. 3C to increase the depth of engagement with the cushion member 40. This gives the cushion member 40 more structure, making it easier to assemble the headband assembly and harder for the end user to disengage the cushion member 40 from the spring member 20.

Also, foam piece 140 is preferably sized and shaped so that when it is installed inside the cushion member 40 it does not create a visible break. The size and shape of foam piece 140 depicted in FIG. 1B can result in a small dimple or discontinuity in the cushion member 40 where the ends of the foam piece 140 tuck into the lower spine members 74, 75, due to the change in elevation of the foam piece 140. This dimple can potentially be eliminated by creating a butt joint between the foam piece 140 and the lower spine members 74, 75, which may allow the end surfaces of the foam piece 140 to terminate in such a way that they create a continuous surface with the lower spine members 74, 75.

Additionally, there are methods other than pressure-sensitive adhesive of attaching the lower spine members 74, 75 to the spring member 20. In one non-limiting example, snap members (such as are used in the upper spine member 71, and not shown in the drawings) could be located around the D-shaped end 113 of the lower spine members 74, 75. These snap members could be configured to couple to the slots in the spring member 20. Alternatively, the lower spine members 74, 75 can be directly attached to the spring member 20, e.g., using rivets or other fasteners. Fasteners would help ensure that the lower spine members 74, 75 are rigidly attached to the spring member 20. Rigid attachment helps alleviate gaps that can open up between the spring member 20 and cushion member 40 when the spring member 20 is opened to be placed on the head. Without rigid attachment, the forces that develop when the spring member 20 is opened can cause the top of the lower spine members 74, 75 to pull away from the spring member 20, resulting in a gap. If rivets or other fasteners are used, it may be preferable to include in cap 80 features that could conceal any attachment features that protrude above the top surface of the spring member 20.

Figure 7A:
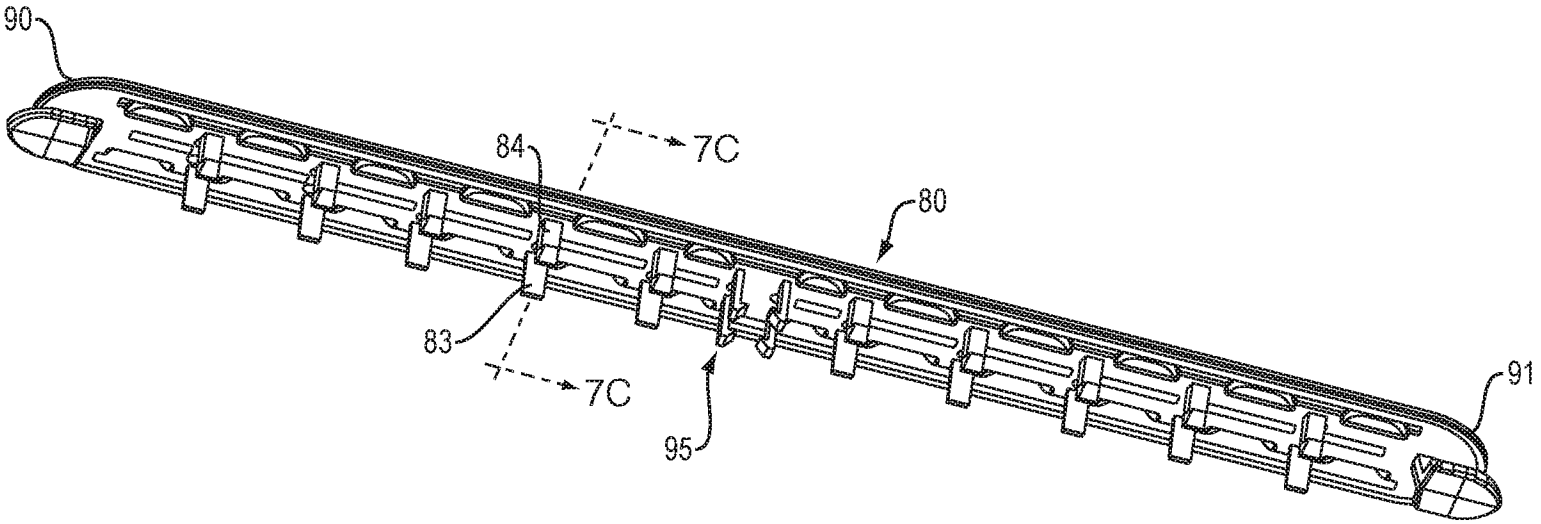
FIG. 7A is a bottom perspective view of a cap of a headband assembly.
Figure 7B:
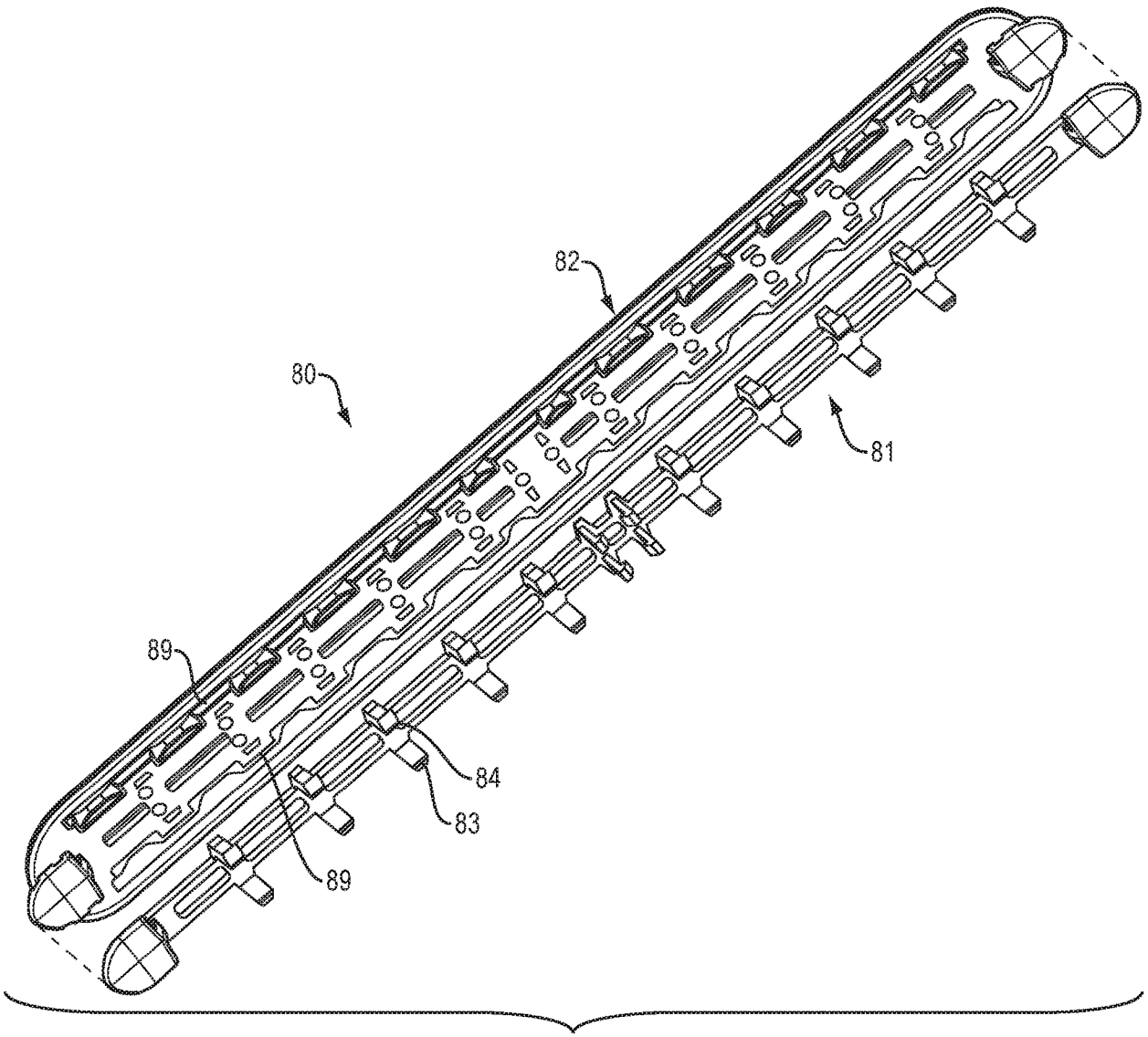
FIG. 7B is an exploded view of the cap of FIG. 7A.
Figure 7C:
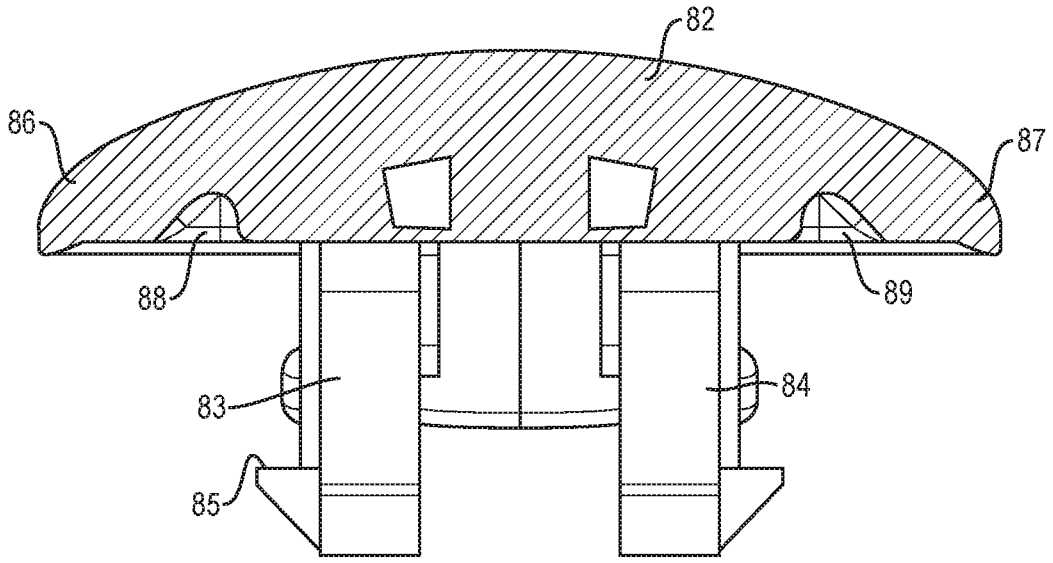
FIG. 7C is a cross-section taken along line 7C-7C, FIG. 7A.

Cap 80 is shown in FIGS. 7A-7C (showing a perspective, exploded, and cross-sectional view of cap 80, respectively). Cap 80 comprises cap spine portion 81 and cap cover portion 82. Cap spine portion 81 and cap cover portion 82 are preferably but not necessarily co-molded (e.g., by two-shot molding or insert molding). Spine portion 81 may be made from a glass-filled nylon or another relatively stiff plastic material, to provide some strength and rigidity to the cap. Cover portion 82 may be made from a silicone. Silicone bonds well to glass-filled nylon, is biocompatible, and presents the same appearance as the cushion member. Making the cushion member and the cap cover (i.e., outer) portion from the same material helps to provide more uniformity to the appearance of the headband assembly. In some examples, cap spine portion 81 and cap cover portion 82 may be constructed of materials of a similar color, to prevent the cap spine portion 81 from being visible through the cap cover portion 82. Further, the cap cover portion 82 is of a sufficient thickness to prevent the cap spine portion 81 from creating indentations that are visible in the cap cover portion 82.

Cap 80 may be configured to couple to the spring member. The manner by which the cap is coupled to the spring member can be but need not be similar to the manner by which the spine is coupled to the spring member. That is, the cap can include snap fit members that engage the edges of the slot in the spring. The cap spine portion may comprise a plurality of spaced coupling tabs, which may be arranged in two spaced rows so that the coupling tabs can engage with both edges of the spring slot. Only two such tabs 83 and 84 are numbered, simply for ease of explanation. Also, a group of coupling tabs 95 may be arranged to engage with spring ridge 29. The spine portion coupling tabs may each comprise a shoulder that is arranged to snap fit with the spring member and sit against and under a spring member slot edge. See, for example, shoulder 85 of coupling tab 83, FIG. 7C. Cap cover portion 82 may have a series of spaced arc-shaped depressions (see FIG. 7B where only one such depression 121 is numbered, simply for the sake of ease of illustration). The curved free distal ends of the upper spine member coupling tabs (which have a shape that is complementary to the depressions) may sit in these depressions. The curvature of the tab ends and the depressions allow the cap cover portion 82 to be thinner than it would need to be if the ends of the tabs were squared off.

The cap cover portion 82 may have outer edges 86 and 87 (FIG. 7C) that engage with (for example, sit on top of) the top surface of the spring member, providing an interference fit between the perimeter of the cover portion 82 and the spring member 20. This way cover portion 82 presents a finished appearance where it interfaces with the spring member. Outer edges 86 and 87 may have elongated grooves (88 and 89, respectively) that increase the compliance of the outer edges of the cover portion. The increased compliance provides increased flexibility to edges 86 and 87 and so allows them to have a more uniform appearance (e.g., without puckering) when sitting on the top of the spring member. In one example the cap spine portion can be pre-molded in a straight configuration. Since the spring member (and the headband assembly) need to follow the curve of the head, once the cap is coupled to the spring member it too will be curved. Curving straight edges of the cap cover portion can make the edges pucker. To inhibit such puckering, the cap cover portion edges may be made more compliant by including grooves 88 and 89 along the two edges. Alternatively, the cap spine portion may be pre-molded in a curved configuration in which case grooves 88 and 89 may not be necessary.

Figure 8B:
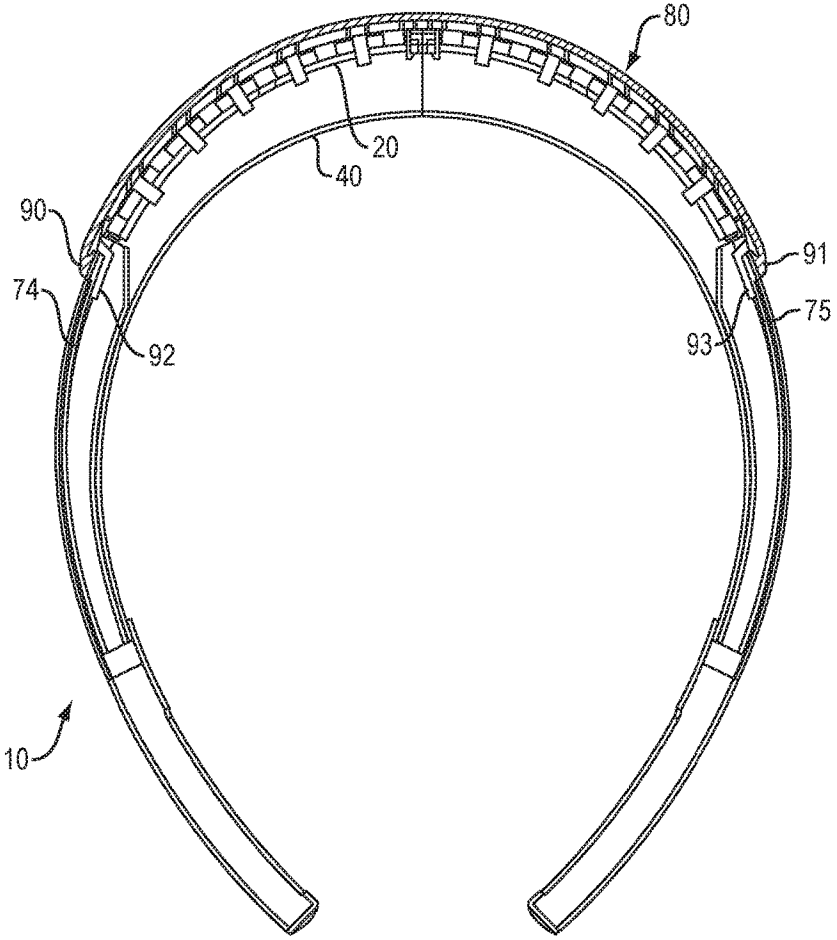
FIG. 8B is a cross-sectional view taken along line 8B-8B, FIG. 8A.
Figure 8A:
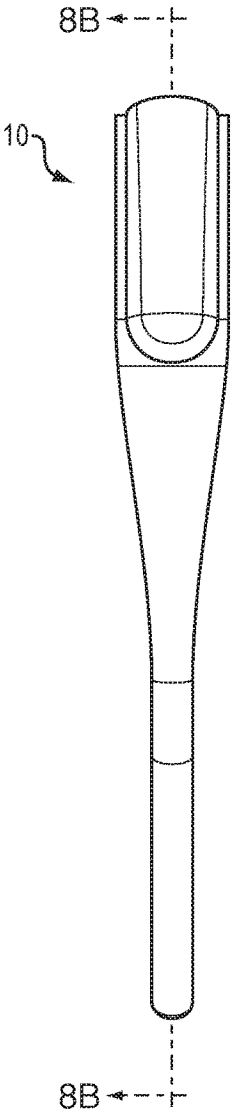
FIG. 8A is side view of the headband assembly.

Cap 80 has opposed ends 90 and 91. Cap spine portion 81 at each cap end may comprise a lower tongue (92 and 93, respectively) that is located underneath spine 60. See FIG. 8B, which illustrates tongues 92 and 93 located underneath lower spine members 74 and 75, respectively. This helps to hold the ends of the cap down and inhibit them from being caught under the ends and lifted off of the spring member. Note that foam piece 140 is not shown in FIG. 8B, simply for the sake of clarity of illustration of the other portions of headband assembly 10.

The snaps on spine 60 and cap 80 help to center the spine and cap within the slot in spring member 20. Cap 80 also serves the purpose of filling in the slot/opening in spring member 20; the slot allows the clamping force of spring member 20 to be tuned to a desired level and so is typically necessary. Cap 80 also helps hide the snaps of spine 60.

Cap 80 can alternatively be attached to spring member 20 using pressure-sensitive adhesive. In this case there could also be a secondary securing feature or features (such as snaps) to prevent users from easily removing cap 80.

A number of implementations have been described. Nevertheless, it will be understood that additional modifications may be made without departing from the scope of the inventive concepts described herein, and, accordingly, other embodiments are within the scope of the following claims.

What is claimed is:

1. A headband assembly that is constructed and arranged to be worn on or over a head of a user, comprising:

a curved compliant spring member;

a cushion member that is configured to be in contact with or proximate the head of the user when the headband assembly is worn by the user;

a spine that is coupled to both the cushion member and the spring member, wherein the spine is elongated, engages along a length of the spring member, and comprises an elongated spring to provide a head clamping force to the spine; and a cap that at least partially overlies the spring member and the spine.

2. The headband assembly of claim 1, wherein the cushion member comprises a pocket, and the spine is received in the pocket.

3. The headband assembly of claim 2, wherein the spine further comprises a plurality of spaced projections on an upper surface of the spine, and the pocket comprises a plurality of spaced openings that are configured to receive the spine projections, to interface and align the spine and the cushion member.

4. The headband assembly of claim 1, wherein the spring member comprises a slot along a length thereof, wherein the slot has edges.

5. The headband assembly of claim 4, wherein the spine comprises a plurality of spaced coupling tabs on an upper surface thereof, wherein the coupling tabs are configured to couple to the spring member slot edges.

6. The headband assembly of claim 5, wherein the coupling tabs each comprise a shoulder that is arranged to snap fit with the spring member and sit against and over a spring member slot edge.

7. The headband assembly of claim 6, wherein the coupling tabs comprise cantilever snap fit members that have curved free distal ends.

8. The headband assembly of claim 1, wherein the cushion member is elongated and has a central portion that is in the middle of the cushion member, and wherein the spine comprises an upper spine member that engages with the central portion of the cushion member.

9. The headband assembly of claim 8, wherein the upper spine member has opposed ends, and wherein the spine further comprises two lower spine members, one proximate each end of the upper spine member.

10. The headband assembly of claim 9, wherein each lower spine member engages with both the cushion member and the spring member.

11. The headband assembly of claim 10, wherein the spring member has a lower surface, and wherein the lower spine members are adhesively engaged with the lower surface of the spring member.

12. The headband assembly of claim 1, wherein the cap comprises a cap spine portion and a cap cover portion.

13. The headband assembly of claim 12, wherein the cap spine portion and the cap cover portion are co-molded.

14. The headband assembly of claim 12, wherein the spring member comprises a slot along a length thereof, wherein the slot has edges, and wherein the cap is elongated and engages with the spring member slot.

15. The headband assembly of claim 14, wherein the cap spine portion comprises a plurality of spaced coupling tabs, and wherein the cap spine portion coupling tabs are configured to couple to the spring member slot edges.

16. The headband assembly of claim 15, wherein the cap spine portion coupling tabs each comprise a shoulder that is arranged to snap fit with the spring member and sit against and under a spring member slot edge.

17. The headband assembly of claim 13, wherein the cap cover portion has outer edges that engage with the spring member.

18. The headband assembly of claim 17, wherein the outer edges of the cap cover portion have elongated grooves that increase the compliance of the outer edges of the cover portion.

19. The headband assembly of claim 12, wherein the cap comprises opposed ends, and wherein the cap spine portion at each cap end comprises a lower tongue that is located underneath the headband assembly spine.

20. The headband assembly of claim 12, wherein the cap spine portion is pre-molded in a straight configuration.

21. The headband assembly of claim 20, wherein the cap cover portion comprises two edges and a groove along each of the two edges.

22. The headband assembly of claim 12, wherein the cap spine portion is pre-molded in a curved configuration.

* * * * *